United States Patent [19]

Flanagan et al.

[11] Patent Number: 4,480,790

[45] Date of Patent: Nov. 6, 1984

[54] ROTARY BURNER

[75] Inventors: Paul Flanagan, Northboro; Mark S. Chumsae, Shrewsbury, both of Mass.

[73] Assignee: Coppus Engineering Corporation, Worcester, Mass.

[21] Appl. No.: 453,815

[22] Filed: Dec. 27, 1982

[51] Int. Cl.[3] ..... B05B 3/06

[52] U.S. Cl. ..... 239/214.25; 431/168; 431/8

[58] Field of Search ..... 431/168; 239/214.13, 239/226, 214.15, 214.25

[56] References Cited

U.S. PATENT DOCUMENTS

| | | | |
|---|---|---|---|
| 1,903,317 | 4/1933 | Tibbot | 431/168 X |
| 2,351,421 | 6/1944 | Gibson | 239/226 |
| 2,491,324 | 12/1949 | Maki | 431/168 X |
| 2,494,893 | 1/1950 | Meyers | 239/226 X |
| 3,358,736 | 12/1967 | Reed et al. | 431/168 X |
| 4,035,133 | 7/1977 | Larcen | 431/12 |

*Primary Examiner*—Samuel Scott
*Assistant Examiner*—Allen J. Flanigan
*Attorney, Agent, or Firm*—Thompson, Birch, Gauthier & Samuels

[57] ABSTRACT

A rotary burner has fuel discharge nozzles arranged exclusively in the high velocity zone of combustion air flow. The resulting annular flame pattern has a central region adjacent to the burner hub which is essentially combustion free.

4 Claims, 5 Drawing Figures

ROTARY BURNER

BACKGROUND

1. Field of the Invention

This invention relates to rotary burners of the type used in large industrial boiler and furnace installations to burn liquid and/or gaseous fuels.

2. Description of the Prior Art

Burners of the above-described type conventionally include a central bearing support surrounded by a somewhat cylindrical housing. These two components cooperate in a radially spaced relationship to define an annular housing chamber having axially aligned inlet and outlet openings. A shaft is journalled for rotation in bearings carried by the bearing support. The end of the shaft adjacent to the housing outlet opening has a hub which carries a plurality of hollow radially disposed driver arms. Conduits extend through the shaft and hub to carry gas and/or a mixture of oil and steam to the driver arms, the latter being provided with fuel discharge nozzles. As herein employed, the term "nozzle" is to be broadly construed to also encompass drilled orifices. The angular arrangement of the fuel discharge nozzles in relation to the shaft axis is such that the fuel exiting therefrom produces a reactive force which rotatively drives the shaft. The shaft is further provided with a fan. The fan operates during shaft rotation to produce a flow of combustion air which flows through the housing chamber through the inlet and outlet openings. The fuel being discharged from the nozzles of the rotating driver arms mixes with the exiting flow of combustion air and is then burnt in a combustion chamber.

Burners of the above-described type have been widely and successfully employed for many years. In some instances, however, their operation has been plagued by a premature burnout of certain component parts, particularly the shaft bearings and the hub supporting the radial driver arms. When such burnouts occur, the burner must be shut down for costly and time consuming repairs.

Over the years, various design modifications have been attempted in order to obviate this problem. Often, such modifications have entailed the use of exotic heat resistant alloys, which significantly increase the cost of the burners. While these attempts have been marginally successful, the problem has to a large extent remained unsolved.

SUMMARY OF THE INVENTION

The present invention stems in large part from the discovery that the flow pattern of the combustion air through the burner housing is divisible into an outer annular high velocity zone adjacent to the housing wall, and an inner annular low velocity zone adjacent to the stationary bearing support. It has been observed that the air flow in the low velocity zone has a tendency to collapse inwardly into a central region adjacent to the shaft hub, whereas the air flow in the high velocity zone continues beyond this central region into the combustion chamber.

In the past, it was thought desirable to achieve a uniform fuel/air mixture across both the high and low velocity zones. This, however, resulted in fuel being injected into the central region adjacent to the hub. As this fuel was burnt, the hub was exposed to extremely high temperatures which eventually caused the hub and shaft bearings to burn out prematurely.

The present invention eliminates this problem by locating the fuel discharge nozzles on the radial driver arms exclusively in the high velocity zone of combustion air flow. This produces an annular flame pattern, with the central region adjacent to the hub remaining combustion-free, thus safeguarding the shaft hub and bearings against premature burnout caused by exposure to excessively high temperatures.

Another object of the present invention is to simplify the overall design of the burner. For example, costly and complicated atomizers which have heretofore been employed to insure proper mixing of steam and oil can now be eliminated. The present invention achieves this objective by introducing the oil and steam into a common conduit extending axially through the shaft. The introduction of both mediums occurs at a location substantially remote from the hub and its radially disposed driver arms, thereby allowing for a natural atomization of the oil in the steam during its travel along the shaft towards the hub.

Costly steam cooled hub protective plates can also be done away with. These design simplifications translate into significant cost savings without in any way adversely affecting burner operation.

These and other objects and advantages of the present invention will be described in greater detail in connection with the accompanying drawings, wherein:

DETAILED DESCRIPTION OF PREFERRED EMBODIMENT

Figure 1:
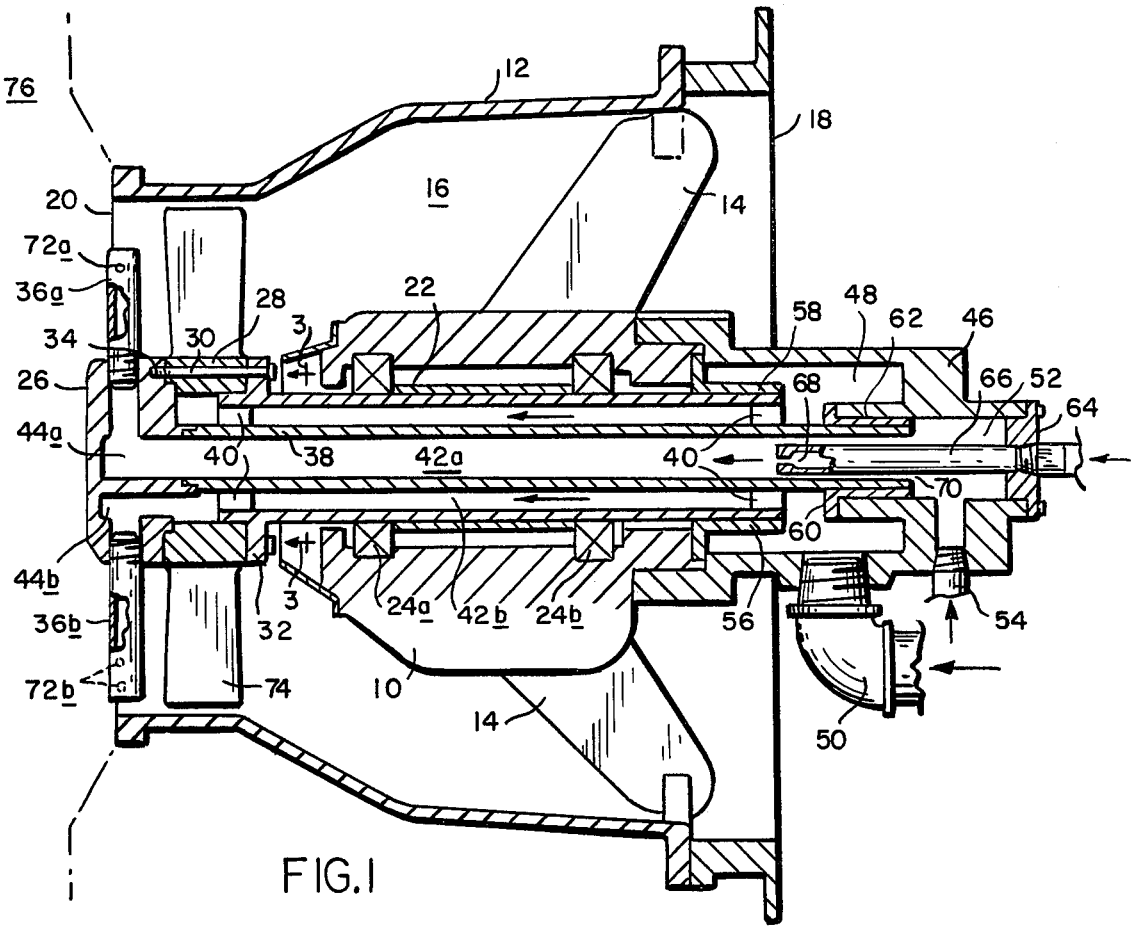
FIG. 1 is a longitudinal sectional view of a rotary burner in accordance with the present invention.
Figure 2:
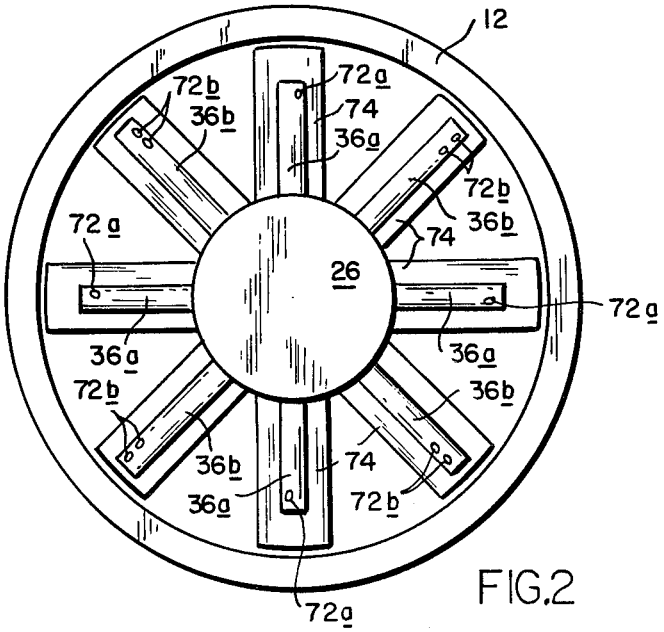
FIG. 2 is a front elevational view of the burner shown in FIG. 1.

Referring initially to FIGS. 1 and 2 of the drawings, a rotary-type burner in accordance with the present invention is shown comprising a stationary hollow bearing support 10 connected to a housing wall 12 by means of radial struts 14. The bearing support and the surrounding housing wall cooperate in a radially spaced relationship to define a substantially annular housing chamber 16 having axially aligned inlet and outlet openings 18, 20.

A tubular shaft 22 extends through the bearing support and is journalled for rotation therein by appropriately positioned bearings **24*a*, 24*b*. A hub 26 and fan 28 are detachably fixed to the shaft 22 by any convenient means, such as for example retainer bolts 30 which extend through a shaft flange 32 and the fan and which are threaded into the hub as at 34. The hub 26 is located adjacent to the outlet opening 20, with the fan 28** being located immediately inboard thereof.

The hub 26 supports a plurality of radially disposed hollow driver arms 36 which for convenience of description will be subdivided into first and second groups 36*a* and 36*b*. An inner tube 38 is supported concentrically within the shaft 22 by spacer elements 40. The tube 38 defines a first conduit, and the shaft 22 and tube 38 cooperate in a radially spaced relationship to define a separate second conduit 42*b* arranged concentrically with respect to the first conduit 42*a*. The first conduit 42*a* is connected via a first manifold arrangement 44*a* in the hub 26 to the first group 36*a* of driver arms. Likewise, the second conduit 42*b* is connected via a second manifold arrangement 44*b* in the hub to the second group 36*b* of driver arms.

A casting 46 is secured to one end of the bearing support 10 and protrudes axially therefrom through the housing inlet opening 18. The casting is subdivided internally into a gas chamber 48 communicating with a gas inlet 50, and a steam chamber 52 communicating with a steam inlet 54. The gas chamber 48 is closed at one end by a stationary bushing 56 which cooperates with the shaft 22 in establishing a sealing relationship therebetween as at 58. Similarly, the other end of the gas chamber 48 is closed and separated from the steam chamber 52 by a second stationary bushing 60 which cooperates with the tube 38 in establishing a sealing relationship therebetween as at 62. A bushing 64 supports an oil inlet pipe 66 which extends inwardly through the steam chamber 52 into the first conduit 42*a*. The end of the pipe 66 defines an oil orifice 68. The oil inlet pipe 66 cooperates in a radially spaced relationship with the interior of the tube 38 to define an annular connecting passageway 70 allowing steam to progess from the steam chamber 52 into the first conduit 42*a*.

Although not illustrated, it will be understood that appropriate valves are provided for controlling the flow of gas, steam and oil through their respective inlets 50, 54 and 66. Thus, when only oil is to be burned, the flow of gas into inlet 50 will be turned off, and appropriate pressurized flows of steam and oil will be admitted via their respective inlets 54, 66. The oil and steam will come into initial contact with each other in the vicinity of the oil orifice 68. As the steam and oil progress along the first conduit 42*a*, the oil will become substantially atomized prior to arriving at the manifold arrangement 44*a* in hub 26. From here, the atomized oil/steam mixture will be fed into the driver arms 36*a*. The driver arms 36*a* provided with oil nozzles 72*a* which are angled with respect to the rotational axis of the shaft 22 in a manner such that the reactive force produced by the oil/steam mixture exiting therefrom will rotatively drive the shaft.

When only gas to be burned, both the oil and steam flow will be shut off, and pressurized gas will be admitted to the gas chamber 48 via its inlet 50. Gas will be bled from chamber 48 to chamber 52 via a transfer valve (not shown). The pressurized gas then will progress along both the first and second conduits 42*a*, 42*b* and through the hub manifolds 44*a*, 44*b* for distribution to both groups of driver arms 36*a*, 36*b*. The arms 36*b* are provided with nozzles 72*b* which are arranged in a manner similar to the nozzles 72*a*, so that the reactive force of the pressurized gas exiting from both nozzles 72*a*, 72*b* will rotatively drive the shaft 22.

This arrangement also makes it possible to burn oil and gas simultaneously.

As the shaft 22 is rotated, the fan blades 74 induce a flow of combustion air which enters the chamber 16 through inlet opening 18 and which exits from the chamber through exit opening 20. The combustion air mixes with the fuel exiting from the nozzles 72*a* and/or 72*b*, and upon ignition, combustion takes place in a combustion chamber 76.

Figure 3:
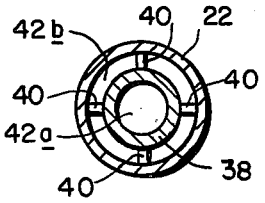
FIG. 3 is a cross sectional view on an enlarged scale taken along line 3—3 of FIG. 1.
Figure 4:
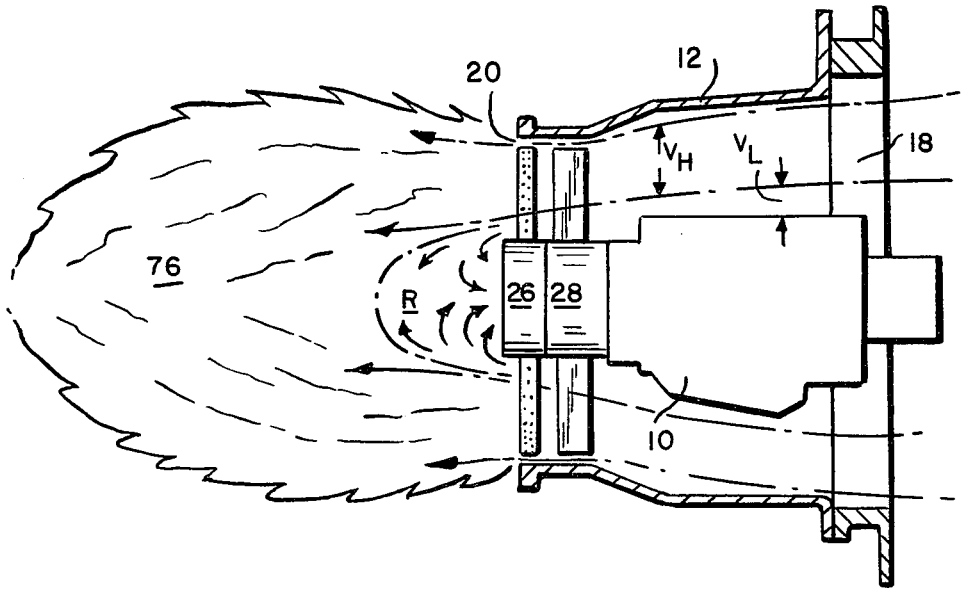
FIG. 4 is a somewhat schematic view of a prior art rotary burner, showing the flame pattern which results when the fuel discharge nozzles in the driver arms are arrayed across both the high and low velocity zones of combustion air flow.
Figure 5:
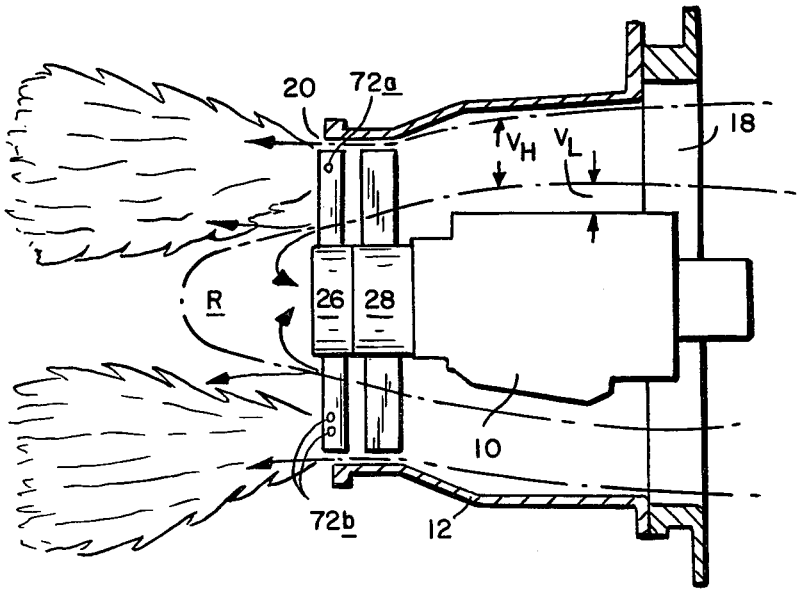
FIG. 5 is a view similar to FIG. 4 showing the flame pattern which results from a positioning of the fuel discharge nozzles exclusively in the high velocity zone of combustion air flow.

Referring now to FIG. 4, an important aspect of the present invention lies in the determination that the combustion air flow through the housing chamber 16 is divisible into an outer annular high velocity zone $V_H$ adjacent to the housing wall 12, and an inner annular low velocity zone $V_L$ adjacent to the bearing support 10. As schematically depicted in FIG. 3, the air flow in the low velocity zone $V_L$ has a tendency, upon exiting from the outlet opening 20, to collapse inwardly into a central region R directly adjacent to the hub 26. In contrast, the air flow in the high velocity zone $V_H$ resists any tendency to collapse inwardly and thus progresses beyond the hub into the combustion chamber 76.

It had heretofore been considered desirable to distribute the fuel discharge nozzles 72*a*, 72*b* along the entire lengths of the driver arms 36*a*, 36*b* in order to produce a substantially uniform fuel/air mixture. However, in so doing, some of the fuel discharge nozzles were located in the low velocity zone $V_L$ of combustion air flow. Thus, as the air flow collapsed inwardly into the central region R, fuel was also pulled into the same region, and as a result combustion took place immediately adjacent to the hub 26. This caused the hub and the shaft bearings to overheat and burn out.

As can be seen in FIG. 4, this problem now has been effectively obviated by locating the fuel discharge nozzles 72*a*, 72*b* entirely in the high velocity zone $V_H$ of combustion air flow. This allows the combustion air flowing through the low velocity zone $V_L$ to remain free of fuel. Thus, as the air flow in the low velocity zone collapses inwardly, the central region R remains essentially flame-free. In contrast to being overheated as with the prior art arrangement, the hub 26 and the shaft bearings 24 are cooled by the collapsing air flow. This safeguards the hub and bearings from burnout, and also makes it possible to use less exotic and lower cost materials for these components.

Returning to FIG. 1, it also should be appreciated that the location of the oil orifice 68 at an upstream location in the first conduit 42*a* is highly advantageous in that it insures proper atomization of the oil in the steam as the two travel towards the hub 26. This is to be contrasted to prior art arrangements, where the oil and steam were conveyed separately to complicated and expensive atomizing components located in the hub.

We claim:

1. A rotary-type fuel burner comprising:

a stationary inner bearing support surrounded by an outer housing, said bearing support and said housing cooperating in a radially spaced relationship to define a substantially annular housing chamber having axially aligned inlet and outlet openings;

a shaft extending through and journalled for rotation in bearings carried by said bearing support;

a hub fixed to said shaft at a location adjacent to said outlet opening, a plurality of hollow driver arms extending radially outwardly from said hub, said arms having nozzles communicating with the interiors thereof;

conduit means extending through said shaft and said hub into communication with said driver arms for conveying pressurized fuel thereto, the arrangement of said nozzles with respect to the rotational axis of said shaft being such that the reactive force produced by pressurized fuel exiting through said nozzles will cause said shaft to be rotatively driven; and a fan mounted for rotation with said shaft, said fan being located in said chamber interiorly of said hub and said driver arms and being operative during shaft rotation to induce a flow of combustion air which enters said chamber through said inlet opening and which exits from said chamber through said outlet opening, the said combustion air flow having an outer annular high velocity zone adjacent to said housing and an inner annular low velocity zone adjacent to said bearing support, the air flow in said inner low velocity zone having a tendency upon exiting through said outlet opening to collapse inwardly into a central region adjacent to said hub, and the air flow in said outer high velocity zone having a tendency to proceed to a combustion zone located axially beyond said central region, said nozzles being located entirely in said outer high velocity zone, whereupon the fuel exiting therefrom is mixed with the air flow in said high velocity zone for ignition and combustion in an annular flame pattern, with said central region remaining essentially flame-free.

2. The rotary burner of claim 1 wherein said conduit means includes first and second conduits extending axially through said shaft from said inlet opening to the hub located adjacent to said outlet opening, and first and second manifold means in said hub for connecting said first and second conduits respectively to first and second groups of said driver arms.

3. The rotary burner of claim 2 wherein said first conduit is arranged concentrically within said second conduit, with means for injecting liquid fuel and steam into said first conduit at a location adjacent to said inlet opening, and with the distance from said inlet opening to said hub being sufficient to permit said liquid fuel to be atomized by said steam prior to the arrival of said fuel/steam mixture at said first group of driven arms.

4. The rotary burner of claim 3 further comprising means for injecting a gaseous fuel into said second conduit.

* * * * *